United States Patent [19]

Dragone

[11] Patent Number: 4,631,545

[45] Date of Patent: Dec. 23, 1986

[54] ANTENNA ARRANGEMENT CAPABLE OF ASTIGMATISM CORRECTION

[75] Inventor: Corrado Dragone, Little Silver, N.J.

[73] Assignee: AT&T Bell Laboratories, Murray Hill, N.J.

[21] Appl. No.: 671,975

[22] Filed: Nov. 16, 1984

[51] Int. Cl.[4] ..... H01Q 19/12

[52] U.S. Cl. ..... 343/779; 343/781 P

[58] Field of Search ..... 343/779, 781 R, 781 P, 343/781 CA, 837, 840, 371, DIG. 2

[56] References Cited

U.S. PATENT DOCUMENTS

| | | | |
|---|---|---|---|
| 3,828,352 | 8/1974 | Drabowitch et al. | 343/837 |
| 3,922,682 | 11/1975 | Hyde | 343/761 |
| 4,145,695 | 3/1979 | Gans | 343/779 |
| 4,203,105 | 5/1913 | Dragone et al. | 343/781 |
| 4,250,508 | 2/1981 | Dragone | 343/781 CA |
| 4,339,757 | 7/1913 | Chu | 343/781 |
| 4,343,004 | 8/1982 | Ohm | 343/781 |
| 4,482,898 | 11/1984 | Dragone et al. | 343/781 P |
| 4,503,435 | 3/1985 | Dragone | 343/781 P |

OTHER PUBLICATIONS

G-AP Intl. Symposium, Sep. 14–16, 1970, Columbus, Ohio; Amitay et al., pp. 408–415.

Proc. IEEE, Feb. 1971, Panicali et al., pp. 311–312.

AP-S Intl. Symposium, 1977, Stanford, Calif., English, pp. 317–320.

AP-S Intl. Symposium, 1978, College Park, Md., Young et al., pp. 249–252.

IEEE Trans. Comm., vol. COM-27, No. 10, Oct., 1979, Acampora et al., pp. 1406–1415.

ICC '80, vol. 2, Seattle, Wash., Jun. 8–12, 1980, Dragone et al., pp. 25.5.1–25.5.7.

*Primary Examiner*—Eli Lieberman

*Assistant Examiner*—Michael C. Wimer

*Attorney, Agent, or Firm*—Erwin W. Pfeifle

[57] ABSTRACT

The present invention relates to an antenna arrangement for correcting for astigmatism is a beam which is linearly scannable in a first principal plane of the antenna arrangement. The antenna arrangement comprises a parabolic or torus main reflector and a feed arrangement for producing first and second astigmatic phase centers which lie along first and second focal lines, respectively, in the first principal plane and match first and second astigmatic phase centers required by the main reflector to produce a linearly scannable plane wave. The feed arrangement comprises a reflector which is parabolic in the first principal plane and cylindrical in the second principal plane and is disposed both (1) confocally with the main reflector to produce an image of the main reflector, and (2) relative to the main reflector to produce the matching first and second astigmatic phase centers; a phased array with its aperture disposed to cover a predetermined portion of the main reflector image; and a pair of waveguide plates disposed parallel to the first principal plane and covering the area between the phased array, the reflector, and the first focal line.

10 Claims, 3 Drawing Figures

10
$B_1$
$C_1$
$A_1$
$\theta_1$
21
20
L'
L"
F"
14
F
12
C
$A_{01}$
15
$C_0$
$B_0$
$21_1$
$20_0$
11
ARRAY LINE L L'
L"
a'
a"
x
y
z
12
17
C
14
F
w
$C_0$
13
15
CENTRAL RAY 20
ARRAY LINE L

ANTENNA ARRANGEMENT CAPABLE OF ASTIGMATISM CORRECTION

TECHNICAL FIELD

The present invention relates to a multibeam antenna arrangement and, more particularly, to a multibeam antenna arrangement comprising a main parabolic or toroidal reflector and a separate feed arrangement for each beam in which the direction of said beam can be varied in a plane orthogonal to a focal line of the main reflector while correcting for astigmatism produced by such variations.

DESCRIPTION OF THE PRIOR ART

Except for possibly the axial beam of an antenna, reflectors generally will introduce some sort of aberration if the feed horn is located away from the geometrical focus. Consequently, the wavefront of an off-axis beam is not planar. This is especially true in multibeam reflector antenna systems. The dominant aberration of an off-set paraboloid reflector illuminated by a point source placed in the vicinity of the focus is astigmatism, causing a phase error over the antenna aperture. In order to eliminate this aberration, the reflector aperture must be illuminated with a wavefront characterized by different centers of curvature in its principal planes. Antenna systems, however, have been previously devised to correct for certain aberrations including astigmatism.

U.S. Pat. No. 3,828,352 issued to S. Drabowitch et al on Aug. 6, 1974, relates to microwave antennas including a toroidal reflector designed to reduce spherical aberrations. The patented antenna structure comprises a first and a second toroidal reflector centered on a common axis of rotation, each reflector having a surface which is concave toward that common axis and has a vertex located in a common equatorial plane perpendicular thereto.

U.S. Pat. No. 3,922,682 issued to G. Hyde on Nov. 25, 1975, relates to an aberration correcting subreflector for a toroidal reflector antenna. More particularly, an aberration correcting subreflector has a specific shape which depends on the specific geometry of the main toroidal reflector.

U.S. Pat. No. 4,145,695 issued to M. J. Gans on Mar. 20, 1979, relates to launcher reflectors which are used with reflector antenna systems to compensate for the aberration of astigmatism which was found to be introduced in the signals being radiated and/or received at the off-axis positions. Each off-axis feed includes an astigmatic launcher reflector having a curvature and orientation of its two orthogonal principal planes of curvature determined with specific relationships.

U.S. Pat. Nos. 4,339,757 issued to T-S Chu on July 13, 1982, and 4,343,004 issued to E. A. Ohm on Aug. 3, 1982, relate to antenna arrangements for correcting for astigmatism and for astigmatism and cross-polarization, respectively. The antenna arrangements include an astigmatic correction means comprising a first and a second doubly curved subreflector which are curved in orthogonal directions and disposed relative to each other in a predetermined manner to provide the desired correction.

U.S. patent application Ser. No. 433,986 filed on Oct. 12, 1982, for C. Dragone et al, now U.S. Pat. No. 4,482,898, relates to an antenna feed arrangement for correcting for astigmatism caused by an offset main reflector. The feed arrangement comprises a small feed horn combined with two parallel conductive plates disposed parallel to the feed axis of the antenna and extending to a point between two orthogonally oriented cylindrical reflectors. Each reflector provides a separate phase center along the feed axis, By moving the reflectors toward or away from each other, the phase centers can be made to match the astigmatism produced by the offset main reflector at a particular feed arrangement location.

The problem remaining in the prior art is to provide a linear scannable antenna feed arrangement which can be disposed next to similar feed arrangements and can provide correction of astigmatism in an associated beam as it is linearly scanned.

SUMMARY OF THE INVENTION

The foregoing problem has been solved in accordance with the present invention which relates to a multibeam antenna arrangement comprising a main parabolic or toroidal reflector and a separate feed arrangement for each linearly scannable beam, the feed arrangement comprising a phased array, and a parabolic cylindrical reflector which is disposed confocally with the main reflector, the phased array and parabolic cylindrical reflector being located between two parallel waveguide plates which are cut along a predetermined focal line of the main reflector to provide a predetermined aperture of the feed arrangement. With the present feed arrangement, the direction of each scannable beam can be moved in a linear direction while appropriate first and second astigmatic phase centers are produced in the principal planes of curvature of the wavefronts radiated by the feed arrangement for correcting for astigmatism produced by the main reflector.

It is an aspect of the present invention to provide a multibeam antenna arrangement which includes a parabolic or toroidal main reflector and a feed arrangement for each beam comprising a phased array, for providing a linearly scannable beam, combined with a parabolic cylindrical reflector confocally disposed with the main reflector. The phased array and the feed reflector are preferably disposed between two parallel waveguide plates that are cut along a predetermined focal line of the main reflector to form a predetermined feed arrangement aperture. Astigmatism is corrected by the parabolic cylindrical reflector which is orthogonal to the two plates and disposed relative to the main reflector to produce movable first phase centers along the symmetry line of the aperture of the feed arrangement and movable second associated phase centers on a focal line disposed at a predetermined angle to, and in the plane of, the symmetry line of the aperture of the feed arrangement. The first and second phase centers are formed by the parabolic cylindrical reflector to match the astigmatism caused by the offset main reflector and by the position of the feed arrangement for any position of the linearly scanned beam.

It is a further aspect of the present invention to provide a plurality of feed arrangements disposed adjacent each other in the vicinity of the focal plane of a main parabolic or torus reflector. Each feed arrangement includes a phased array, a parabolic cylindrical reflector, disposed confocally with the main reflector, and a pair of parallel waveguide plates which cover the area between the phased array, the reflector, and a predetermined focal line of the main reflector. The feed arrangement corrects for astigmatism in the linearly scannable beam produced by the phased array with the parabolic cylindrical reflector in the feed arrangement which is orthogonal to the two plates and disposed relative to the main reflector for producing movable phase centers which match the astigmatism generated in a beam as that beam is linearly scanned over a predetermined area of the field of view of the antenna arrangement.

Other and further aspects of the present invention will become apparent during the course of the following description and by reference to the accompanying drawings.

DETAILED DESCRIPTION

In most reflector antennas, the feed illuminates the antenna aperture with a spherical wave originating from a feed phase center F'. The phase center F' is placed in the vicinity of the antenna focus, F, and the antenna beam direction can be changed by moving the phase center from focus F to focus F'. In the satellite antenna described in the articles "A Satellite System With Limited-Scan Spot Beams" by A. S. Acampora et al in *IEEE Trans. on Comm., Vol. COM*-27, No. Oct. 10, 1979, at pages 1406–1415; and "New Techniques For the Design of Communication Satellite and Earth Station Antennas" by C. Dragone et al, in ICC '80, Vol. 2, Seattle, Wash., June 8–12, 1980, at pages 25.5.1–25.5–7, the location of phase center F' in the antenna focal plane was moved along straight line L' by varying the excitation of a linear array. The movement of focus F' along line L' was obtained by combining the array with a parallel plate waveguide, containing an imaging arrangement of one or more cylindrical reflectors. The line L' was the symmetry line of the feed aperture, which was placed in the focal plane of a Cassegrainian arrangement of two reflectors. In accordance with the prior art references, a Cassegrainian arrangement was needed in order to minimize aberrations in the vicinity of the focus F. In accordance with the present invention, however, the Cassegrainian arrangement of the prior references can be replaced by a single off-set main parabolic or torus reflector, since the resulting aberrations are corrected substantially entirely by the present linear scan feed arrangement shown in FIG. 1.

Figure 1:
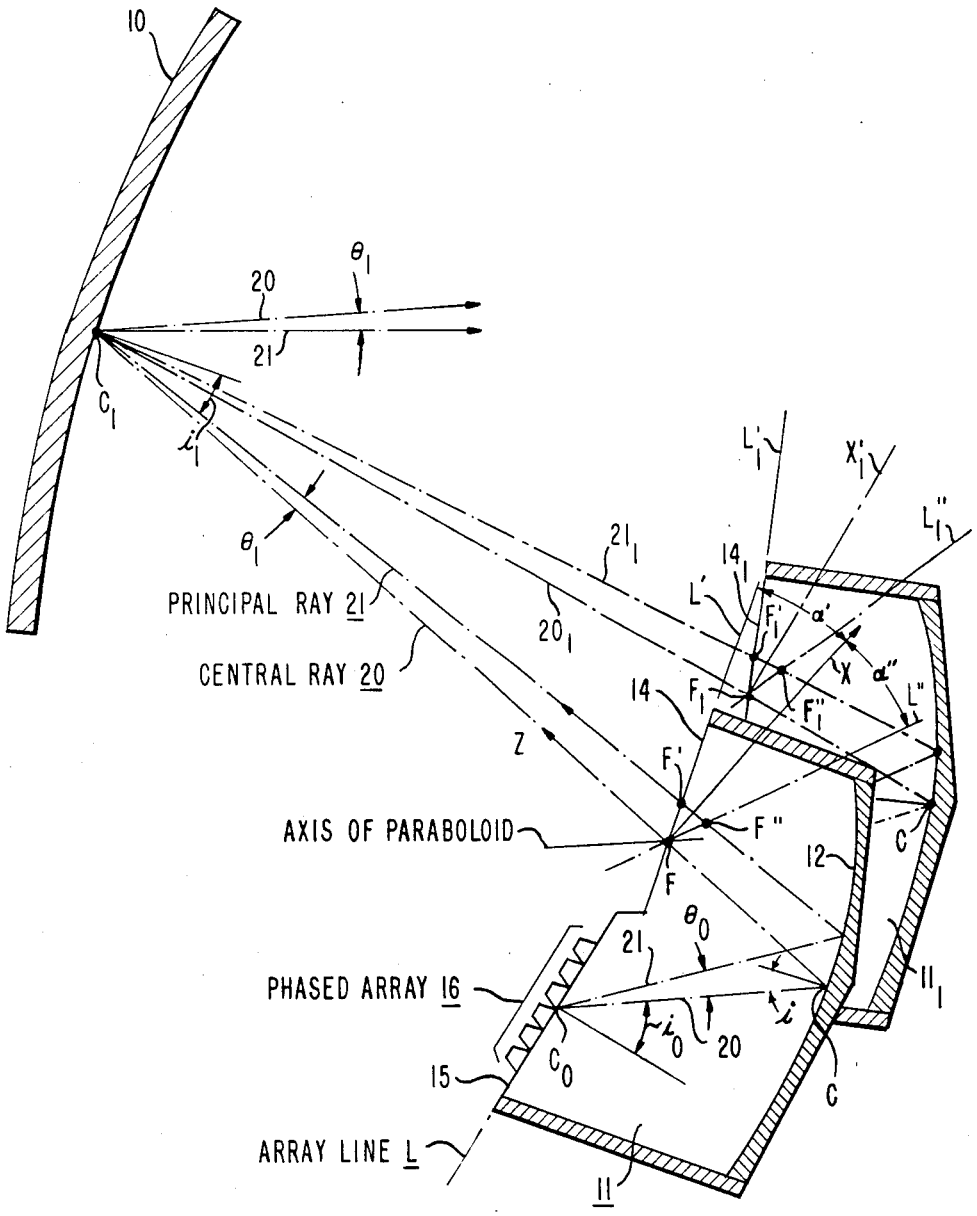
FIG. 1 is a view in cross-section of an antenna arrangement in accordance with the present invention.
Figure 2:
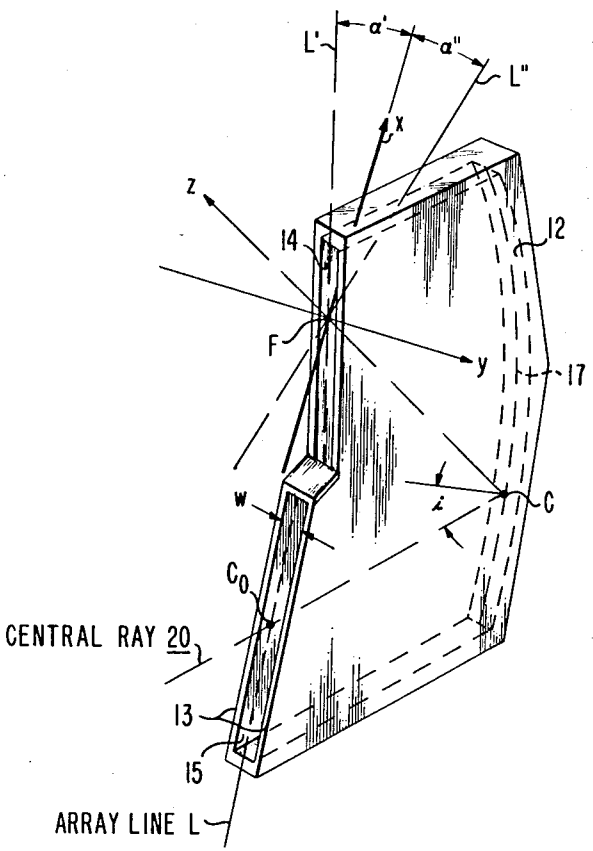
FIG. 2 is a view in perspective of the feed arrangement in the antenna arrangement of FIG. 1.

FIG. 1 illustrates an antenna arrangement in accordance with the present invention which includes (1) a main parabolic or torus reflector 10, which is shown off-set, and (2) a feed arrangement 11, shown in perspective in FIG. 2, comprising a parabolic cylindrical reflector 12 with a focal point F which is confocal with a focal point F of main reflector 10, a pair of parallel plate waveguides 13 formed between reflector 12 and both an aperture 14 to the feed arrangement 11 including a symmetry line L' and an opening 15 where a linear phased array 16 of N feed elements is disposed along an array line L. The array line L centered on opening 15, a central line 17 on the parabolic curve of reflector 12, and a symmetry line L' along the long axis of aperture 14 and passing through focal point F are all disposed in the symmetry plane of the feed.

The dominant aberration of an off-set parabolic or torus main reflector 10 illuminated by a point source displaced along the x axis from the focus F of main reflector 10 is astigmatism causing a phase error $k\delta V_2$ given by $$\delta V_2 = \tfrac{1}{2} \tan ix(p^2 - g^2) \tag{1}$$

where x is the distance along the x axis from focus F and p, q are the direction cosines of a ray measured with respect to the x, y axes located in the focal plane through focus F. In order to eliminate the astigmatism, the main reflector aperture must be illuminated with a wavefront characterized by different centers of curvature F' and F'' in the principal planes of the wavefront. In accordance with the present invention, the feed arrangement shown in FIG. 7 of the C. Dragone et al reference mentioned hereinabove is modified so as to obtain two movable phase centers F' and F'', which move along focal lines L' and L'', respectively, in present FIGS. 1 and 2 instead of the single phase center in the prior art reference which moves along the X axis of present FIGS. 1 and 2 and corresponds to the the aperture of the feed arrangement in the prior art reference. In accordance with the present invention, one of phase centers, F', is located on the symmetry line L' of the feed aperture. The other phase center, F'', however, is located on a different line L'', determined by the parabolic cylindrical reflector 12 as will be now described.

Consider in FIG. 2 the feed plane of symmetry (the plane y=0) and let the curve corresponding to cylindrical reflector 12 be a parabola with focus F and axis parallel to the ray $C_oC$. This ray, which originates from the center $C_o$ of the aperture of array 16, passes through the focus F after reflection and propagates to the center of the far field of view after reflection by main reflector 10, will be called the central ray. Now let the array aperture be illuminated by a plane wave and assume that the principal ray 21 thereof, which does not go to the center of the far field of view and originates from $C_o$, makes a nonzero angle $\theta_o$ with respect to central ray 20 as shown in FIG. 1. Then, after reflection by parabolic cylindrical relector 12, the intersections of the principal ray 21 with lines L' and L'' are the two phase centers F' and F'' shown in FIG. 1. Notice in FIG. 1, in order to illuminate efficiently the paraboloid main reflector 10, the principal ray 21 must pass through the center $C_1$ of the main reflector aperture. This requires that the distances $d_1$ and $d_o$ of $C_1$ and $C_o$ from C in FIG. 1 satisfy the lens equation $$\frac{1}{d_1} + \frac{1}{d_0} = \frac{1}{f} \tag{2}$$

where f is the focal length FC. Then, since $C_1$ and $C_o$ are conjugate points, the principal ray 21 passes through $C_1$ after reflection as shown in FIG. 1. The angle $\theta_1$, between the principal ray 21 and the central ray 20 at $C_1$ of main reflector 10, is related to the corresponding angle $\theta_o$ at $C_o$ by the familiar relation $$\theta_o/\theta_1 = M, \tag{3}$$

where M is the magnification given by $$M = d_1/d_o. \tag{4}$$

To determine the location of F'', consider in FIG. 1 the reflected rays obtained for a give value of $\theta_o$. The focal point of these rays is F''. One finds that the angle $\alpha''$ between axis X and focal line L'' in FIG. 1 is simply equal to the angle of incidence i at C.

Now consider the paraboloid main reflector 10 illumination obtained in FIG. 1 by such a feed 16. In the feed plane of symmetry the wavefront through $C_1$ at main reflector 10 is centered at F'' and its pattern of illumination is simply the image of the array 16 illumination. The magnification of the image is M. In the other principal plane of the feed, the center of curvature F' is the intersection of the principal ray 21 with the line L' corresponding to the feed aperture 14.

The illumination of main reflector 10 in this plane depends upon the spacing W between the two plates 13 of feed arrangement 11 and the polarization of array 16.

The nonzero angles $\alpha'$ and $\alpha''=i$ in FIG. 1 cause both centers of curvature F' and F'' to be slightly displaced from the focal plane z=0. As a consequence, the illumination of main reflector 10 has a phase error $k\delta V'_2$ given by $$\delta V'_2 = -\tfrac{1}{2}x[\tan i p^2 - \tan \alpha' q^2], \tag{5}$$

where p, q, are the x, y direction cousines for the particular ray under consideration, and x is the coordinate intercepted by the principal ray 21 on the x-axis. In addition to the quadratic component given by Equation (5), the aperture phase error contains a component of order 3 in p, q given by $$\delta V'_3 \approx -\tfrac{1}{4}xp^3, \tag{6}$$

neglecting a smaller component porportional to $\tan^2 i$. If it is now recalled that the aberration function $\delta V$ for an off-set paraboloid is given by $$\delta V = \delta V_2 + \delta V_3 + \ldots,$$

with $\delta V_2$ given by Equation (1) and $$\delta V_3 \approx \tfrac{1}{4}xp(p^2+q^2) + \ldots \tag{7}$$

Thus, from Equations (1, 5) there is obtained $$\delta V_2 + \delta V'_2 = \tfrac{1}{2}(\tan i_1 - \tan i)xp^2 - \tfrac{1}{2}(\tan i_1 - \tan \alpha')xq^2, \tag{8}$$

which vanishes for $$i = \alpha' = i_1 \tag{9}$$

Then, the antenna aperture is free of astigmatism for small values of $\delta\theta_o$. Furthermore, the residual aberration $$\delta V_3 + \delta V'_3 = \tfrac{1}{4}xpq^2 + \ldots \tag{10}$$

is considerably reduced in comparison to $\delta V_3$.

Figure 3:
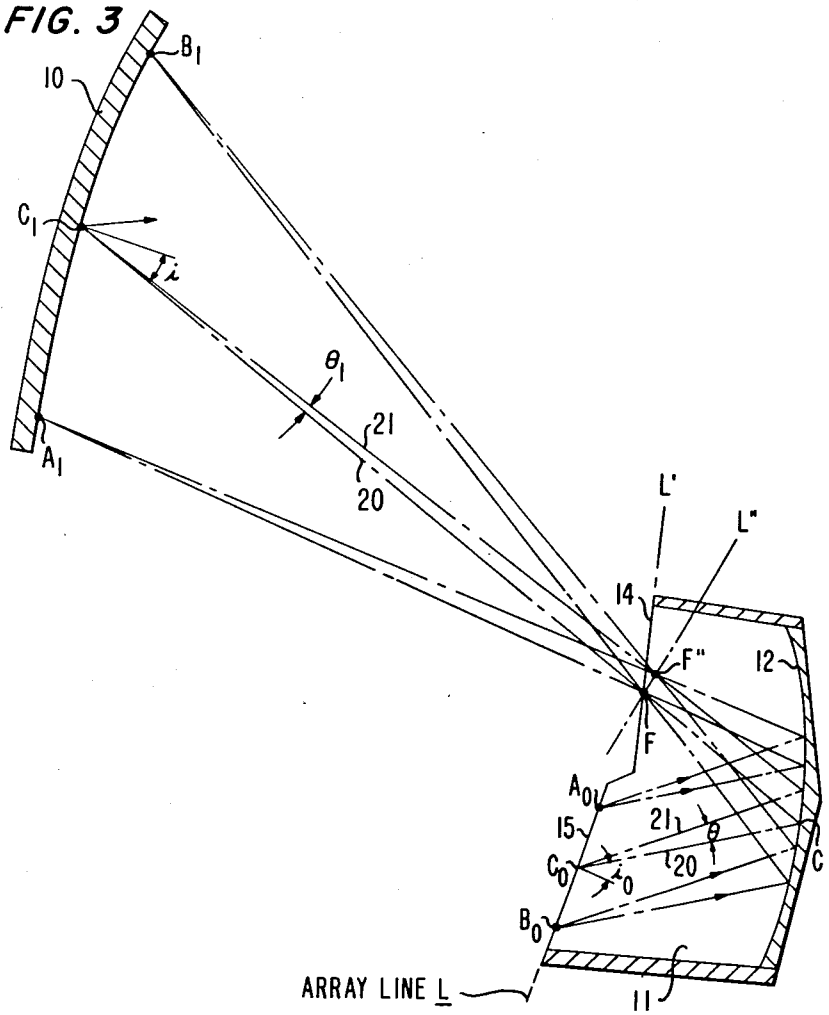
FIG. 3 is a supplementary view in cross-section of the antenna arrangement of FIG. 1 illustrating rays from the center and ends of the linear array for two separate beams and the imaging performed at the main reflector.

In FIG. 1, it should be noted that the array line L is not disposed orthogonal to central ray 20, but makes an angle $i_o$ therewith. This arrangement is preferred in order to insure that the images of the two eges $A_o$, $B_o$ of the array coincide with corresponding edges of the main reflector, as illustrated in FIG. 3. Such condition requires that $$\frac{\tan i_0}{d_0} + \frac{\tan i_1}{d_1} = \frac{2}{f_1}\tan i \tag{11}$$

From the foregoing discussion, it can be seen that in FIG. 1, first the main reflector 10 focal length, angle of incidence and aperture size is determined. Then, the feed arrangement 11 can be designed and disposed relative to main reflector 10 so that (1) the aperture 14 of the feed arrangement 11 is centered at the focus F of central ray 20, (2) the array aperture 15 along line L is at the image of a predetermined portion of main reflector 10, (3) that the feed line L' is positioned so that $\alpha'=i_1$, and (4) that the angle of incidence i on reflector 12 at C is equal to $i_1$. It will also be found that $\alpha'$ is substantially equal to $\alpha''$ for the above conditions. It is to be understood that the axis x in FIG. 1 is orthogonal to central ray 20.

It is to be understood that the abovedescribed embodiments are simply illustrative of the principles of the invention. Various other modifications and changes may be made by those skilled in the art which will embody the principles of the invention and fall within the spirit and scope thereof. For example, it is to be understood that the major aspect of the present invention is to provide a linear scanning feed arrangement for a parabolic or torus main reflector which provides astigmatism correction by providing a feed arrangement reflector which produces moving first and second phase centers along the line of scan that matches the astigmatism generated by a linear scanned beam from an image surface of the main reflector. Therefore, the feed arrangement can comprise a plurality of the feeds described hereinbefore, as shown in FIG. 1 for two feed arrangements 11, which are excited by linear arrays disposed adjacent each other in the vicinity of the focal plane corresponding to the main reflector as described hereinbefore for providing a corresponding plurality of linear scanned beams which are each scanned over a separate linear portion thereof. Additionally, plates 13 are provided to guide the rays of the linearly scanned beam and generate point sources along aperture symmetry line L' after reflection by feed reflector 12.

What is claimed is:

1. An antenna arrangement comprising:

an offset main reflector comprising a reflecting surface for reflecting a substantially planar wavefront impinging the reflecting surface in a predetermined direction from the far field of view of the antenna arrangement to an associated spherical reflected wavefront including first and second astigmatic phase centers which (a) increasingly separate in a direction away from a common focal point (F) on a focal plane of the main reflector along first and second focal lines, respectively, when the planar wavefront is moved, and (b) are located in respective first and second principal planes of curvature of the reflected wavefront; and a feed arrangement comprising:

a parabolic cylindrical reflector including a parabolic reflecting curve in a plane of symmetry of the feed arrangement which corresponds to the first principal plane of the reflected wavefront from the main reflector, the reflector of the feed arrangement being disposed both (a) confocally with the common focal point (F) of the main reflector and along a reflected central ray from the far field of view of the antenna arrangement, and (b) relative to the main reflector for producing movable first and second astigmatic phase centers for rays in the plane of symmetry of the feed arrangement which correspond to locations of the first and second astigmatic phase centers when moving the planar wavefront in the first principal plane of the reflected wavefront, the first and second astigmatic phase centers being disposed on opposite sides of an axis (X) of the antenna arrangement in the first principal plane of the reflected wavefront which passes through the common focal point (F) and is orthogonal to the central ray, and a phase array comprising N feed elements for providing a linearly scannable beam along the plane of symmetry of the feed arrangement, the N feed elements comprising an aperture thereof which is disposed to cover a predetermined portion of the image of the main reflector.

2. An antenna arrangement according to claim 1 wherein the parabolic reflecting surface of the reflector of the feed arrangement is contoured and disposed relative to the main reflector such that angles of incidence for the central ray at both the main reflector and the reflector of the feed arrangement, and the predetermined angle of divergence of the first focal line from the focal surface of the main reflector are substantially equal.

3. An antenna arrangement according to claim 1 or 2 wherein the feed arrangement further comprises:

a first and a second waveguide plate disposed parallel to both each other and the plane of symmetry of the feed arrangement and enclosing the area between the aperture of the phased array, the reflector, and the first focal line of the first astigmatic phase centers.

4. An antenna arrangement according to claim 3 wherein the main reflector comprises a parabolic reflecting surface.

5. An antenna arrangement according to claim 3 wherein the main reflector comprises a toroidal reflecting surface.

6. An antenna arrangement according to claim 1 wherein the offset main reflector is capable of reflecting a second substantially planar wavefront impinging the reflecting surface in a second predetermined direction, which is different than the first predetermined direction, into a second reflected wavefront including first and second astigmatic phase centers which (a) increasing separate in a direction away from a common second focal point ($F_1$) on the focal plane of the main reflector along first and second focal lines, respectively, when the second planar wavefront is moved, and (b) are located in respective first and second principal planes of curvature of the second reflected wavefront, and the antenna arrangement further comprises:

at least a second feed arrangement, each second feed arrangement comprising:

a parabolic cylindrical reflector including a parabolic reflecting curve in a plane of symmetry of the second feed arrangement which corresponds to the first principal plane of the second reflected wavefront from the main reflector, the reflector of the second feed arrangement being disposed both (a) confocally with the second common focal point ($F_1$) of the main reflector and along a second reflected central ray from the far field of view of the antenna arrangement, and (b) relative to the main reflector for producing movable first and second astigmatic phase centers for rays in the plane of symmetry of the second feed arrangement which correspond to locations of the first and second astigmatic phase centers when moving the planar wavefront in the first principal plane of the second reflected wavefront, the first and second astigmatic phase centers being disposed on opposite sides of an axis ($X_1$) of the antenna arrangement in the first principal plane of the second reflected wavefront which passes through the second common focal point ($F_1$) and is orthogonal to the second central ray, and a phased array comprising N feed elements for providing a linearly scannable beam along the plane of symmetry of the second feed arrangement, the N feed elements comprising an aperture thereof which is disposed to cover a predetermined second portion of the image of the main reflector.

7. An antenna arrangement according to claim 6 wherein the parabolic reflecting surface of the reflector of the at least second feed arrangement is contoured and disposed such that (1) an angle of incidence for the central ray at both the main reflector and the at least second feed arrangement reflector, and (2) the predetermined divergence angle between the first focal line and the focal plane of the main reflector are all substantially equal.

8. An antenna arrangement according to claim 6 or 7 wherein the at least second feed arrangement further comprises:

a first and a second spaced-apart waveguide plate disposed parallel to both each other and the plane of symmetry of the at least second feed arrangement, the first and second waveguide plates enclosing the area between the aperture of the phased array, the reflector, and the first focal line of the first astigmatic phase centers.

9. An antenna arrangement according to claim 8 wherein the main reflector comprises a parabolic reflecting surface.

10. An antenna arrangement according to claim 8 wherein the main reflector comprises a toroidal reflecting surface.

* * * * *